US011400720B2

(12) United States Patent
Numajiri et al.

(10) Patent No.: US 11,400,720 B2
(45) Date of Patent: Aug. 2, 2022

(54) LIQUID EJECTING APPARATUS AND MAINTENANCE METHOD FOR LIQUID EJECTING APPARATUS

(71) Applicant: SEIKO EPSON CORPORATION, Tokyo (JP)

(72) Inventors: Tomohiro Numajiri, Shiojiri (JP); Satoru Kobayashi, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 52 days.

(21) Appl. No.: 16/877,571

(22) Filed: May 19, 2020

(65) Prior Publication Data

US 2020/0369034 A1 Nov. 26, 2020

(30) Foreign Application Priority Data

May 22, 2019 (JP) ..... JP2019-096192

(51) Int. Cl.
*B41J 2/165* (2006.01)

(52) U.S. Cl.
CPC ..... *B41J 2/16535* (2013.01); *B41J 2/16588* (2013.01)

(58) Field of Classification Search
CPC ..... B41J 2/16535; B41J 2/16588; B41J 2/16517; B41J 2/16538
See application file for complete search history.

(56) References Cited

U.S. PATENT DOCUMENTS

| | | | | |
|---|---|---|---|---|
| 2002/0122092 | A1 | 9/2002 | Okamura et al. | |
| 2006/0012629 | A1 | 1/2006 | Yoshida | |
| 2007/0070116 | A1 | 3/2007 | Kojima | |
| 2009/0189945 | A1 | 7/2009 | Sekiyama | |
| 2011/0080445 | A1* | 4/2011 | Shimizu | B41J 2/16538 347/31 |
| 2014/0292918 | A1 | 10/2014 | Shimizu | |
| 2015/0085012 | A1* | 3/2015 | Shimizu | B41J 2/16588 347/29 |
| 2017/0096008 | A1 | 4/2017 | Nakagawa et al. | |
| 2017/0253045 | A1 | 9/2017 | Hirabayashi et al. | |
| 2018/0126737 | A1 | 5/2018 | Asano | |

(Continued)

FOREIGN PATENT DOCUMENTS

| | | | |
|---|---|---|---|
| JP | H02-078563 | A | 3/1990 |
| JP | H08-000867 | U | 5/1996 |

(Continued)

*Primary Examiner* — Sharon Polk
(74) *Attorney, Agent, or Firm* — Workman Nydegger

(57) ABSTRACT

A liquid ejecting apparatus includes a liquid ejecting portion that has a nozzle opening surface on which a plurality of nozzles open, and that ejects a liquid from the nozzles to a medium in an inclined state in which the nozzle opening surface is inclined, a first cleaning portion that has a wiping member configured to wipe the nozzle opening surface by moving relative to the liquid ejecting portion in a state of being in contact with the nozzle opening surface, and a second cleaning portion that is formed of an absorbing member configured to absorb the liquid and that has an end portion cleaning member configured to wipe a lower end of the nozzle opening surface in the inclined state by moving relative to the liquid ejecting portion in a state of being in contact with the lower end.

14 Claims, 9 Drawing Sheets

(56) References Cited

U.S. PATENT DOCUMENTS

| | | | |
|---|---|---|---|
| 2018/0222204 | A1 | 8/2018 | Takanashi |
| 2018/0311961 | A1 | 11/2018 | Kiuchi et al. |

FOREIGN PATENT DOCUMENTS

| | | | | | |
|---|---|---|---|---|---|
| JP | H08-142345 | A | | 6/1996 | |
| JP | H09-024617 | A | | 1/1997 | |
| JP | H10-258514 | A | | 9/1998 | |
| JP | 2000-141674 | A | | 5/2000 | |
| JP | 2000-141691 | A | | 5/2000 | |
| JP | 2000-198211 | A | | 7/2000 | |
| JP | 2001-001533 | A | | 1/2001 | |
| JP | 2007331116 | A | * | 12/2007 | ..... B41J 2/16585 |
| JP | 2008-168471 | A | | 7/2008 | |
| JP | 2009-172981 | A | | 8/2009 | |
| JP | 2010-221713 | A | | 10/2010 | |
| JP | 2011-079170 | A | | 4/2011 | |
| JP | 2014-100799 | A | | 6/2014 | |
| JP | 2014-195880 | A | | 10/2014 | |
| JP | 2017-071062 | A | | 4/2017 | |
| JP | 2017-136795 | A | | 8/2017 | |
| JP | 2017-159458 | A | | 9/2017 | |
| JP | 2018-079684 | A | | 5/2018 | |
| JP | 2018-126945 | A | | 8/2018 | |
| JP | 2018-187824 | A | | 11/2018 | |
| WO | 2005/037559 | A | | 4/2005 | |

* cited by examiner

LIQUID EJECTING APPARATUS AND MAINTENANCE METHOD FOR LIQUID EJECTING APPARATUS

The present application is based on, and claims priority from JP Application Serial Number 2019-096192, filed May 22, 2019, the disclosure of which is hereby incorporated by reference herein in its entirety.

BACKGROUND

1. Technical Field

The present disclosure relates to a liquid ejecting apparatus such as a printer and a maintenance method for the liquid ejecting apparatus.

2. Related Art

For example, as in JP-A-2018-187824, there is a printer that is an example of a liquid ejecting apparatus that performs printing by ejecting ink, which is an example of a liquid, from a recording head, which is an example of a liquid ejecting portion. The recording head ejects ink from an ejection port, which is an example of a nozzle provided on an ejection port surface, which is an example of a nozzle opening surface. The printer performs a recording operation, which is an example of printing, on a recording medium, which is an example of a medium, in a state in which the ejection port surface is inclined with respect to a horizontal direction.

A liquid that cannot be wiped off or a liquid that has been scattered during printing may adhere to the nozzle opening surface. The liquid adhering to the nozzle opening surface may move downward along the inclined nozzle opening surface and accumulate. When the medium comes into contact with the accumulated liquid, there is a possibility that the medium may become soiled and print quality may be reduced.

SUMMARY

According to an aspect of the present disclosure, a liquid ejecting apparatus includes a liquid ejecting portion that has a nozzle opening surface on which a plurality of nozzles open, and that ejects a liquid from the nozzles to a medium in an inclined state in which the nozzle opening surface is inclined, a first cleaning portion that has a wiping member configured to wipe the nozzle opening surface by moving relative to the liquid ejecting portion in a state of being in contact with the nozzle opening surface, and a second cleaning portion that is formed of an absorbing member configured to absorb the liquid and that has an end portion cleaning member configured to wipe a lower end of the nozzle opening surface in the inclined state by moving relative to the liquid ejecting portion in a state of being in contact with the lower end.

According to another aspect of the present disclosure, a maintenance method for a liquid ejecting apparatus including a liquid ejecting portion that has a nozzle opening surface on which a plurality of nozzles open, and that ejects a liquid from the nozzles to a medium in an inclined state in which the nozzle opening surface is inclined, a wiping member configured to wipe the nozzle opening surface, and an end portion cleaning member formed of a member configured to absorb the liquid and configured to wipe a lower end of the nozzle opening surface in the inclined state, the maintenance method including wiping the nozzle opening surface by moving the wiping member relative to the liquid ejecting portion in a state in which the wiping member is in contact with the nozzle opening surface, and wiping the lower end by moving the end portion cleaning member relative to the liquid ejecting portion in a state in which the end portion cleaning member is in contact with the lower end.

DESCRIPTION OF EXEMPLARY EMBODIMENTS

Figure 1:
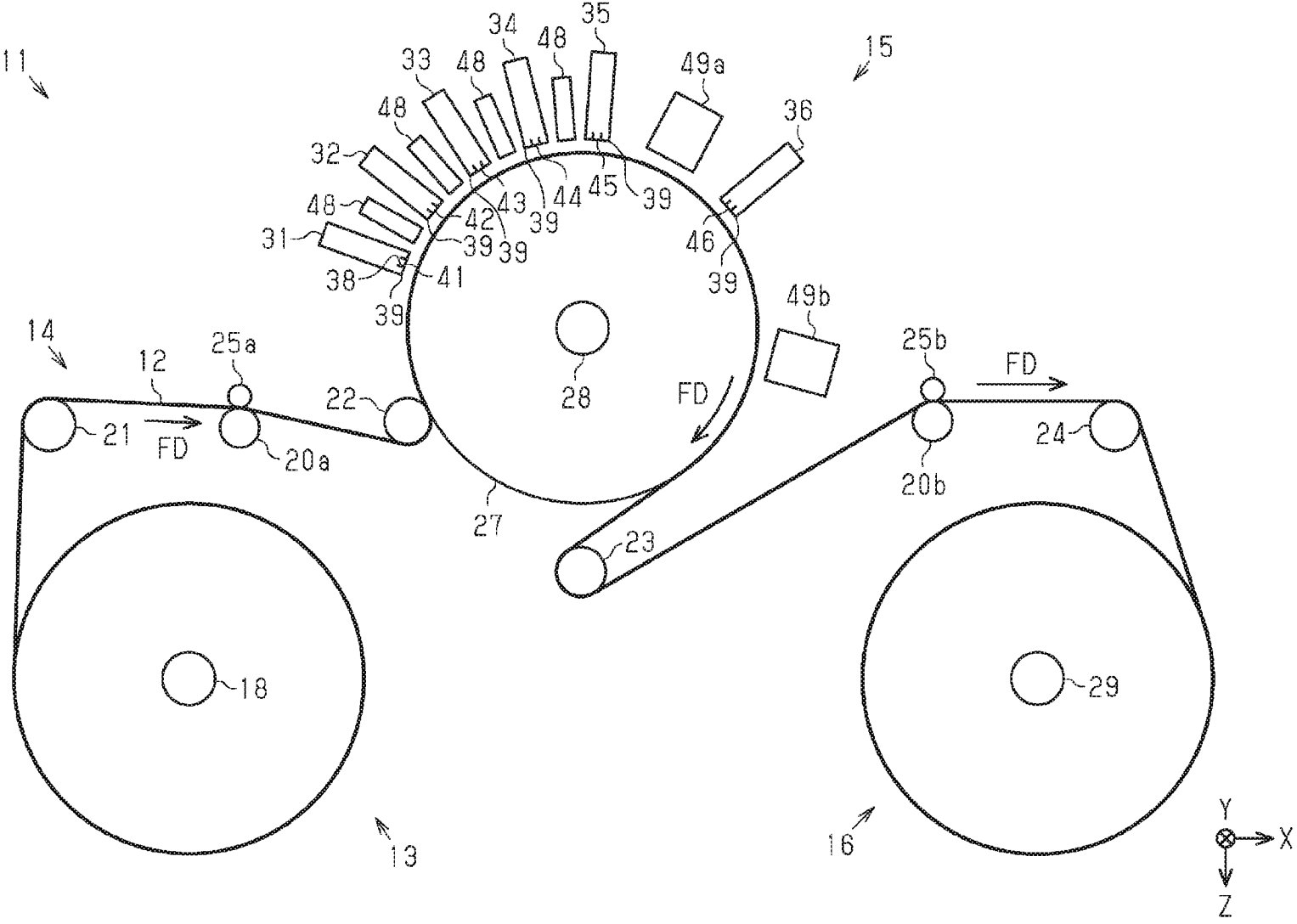
FIG. 1 is a schematic front view of an embodiment of a liquid ejecting apparatus.

Hereinafter, an embodiment of a liquid ejecting apparatus and a maintenance method for the liquid ejecting apparatus will be described with reference to the drawings. The liquid ejecting apparatus is, for example, an ink jet printer that ejects ink, which is an example of a liquid, onto a medium such as paper, and that performs printing.

In the drawings, the direction of gravity is indicated by the Z axis assuming that a liquid ejecting apparatus 11 is placed on a horizontal plane, and directions along the horizontal plane are indicated by the X axis and the Y axis. The X, Y, and Z axes are perpendicular to each other. In the following description, the X-axis direction is also referred to as the horizontal direction X, the Y-axis direction as the width direction Y, and the Z-axis direction as the direction of gravity Z.

As illustrated in FIG. 1, the liquid ejecting apparatus 11 includes a feeding portion 13 that feeds a medium 12 that is long, a transport portion 14 that transports the medium 12 in a transport direction FD, a printing portion 15 that prints on the medium 12 to be transported, and a winding portion 16 that winds the medium 12 that has been printed on. The transport direction FD is a direction along a transport path of the medium 12, and is a direction from the feeding portion 13 to the winding portion 16.

The feeding portion 13 includes a feeding shaft 18 extending in the width direction Y. The feeding shaft 18 is provided so as to rotate with the driving of a feed motor (not illustrated). The medium 12, which is long, is supported by the feeding shaft 18 so as to be integrally rotatable with the feeding shaft 18 in a state of being wound in advance in a roll shape. The medium 12 is wound with the print surface to be printed on facing outward. The feeding shaft 18 rotates clockwise in FIG. 1 to feed the medium 12.

The transport portion 14 may include a first drive roller 20*a* and a second drive roller 20*b* that transport the medium 12, and first to fourth driven rollers 21 to 24 that are driven to rotate with respect to the medium 12 being transported. A plurality of minute projections may be provided on the outer peripheral surfaces of the first drive roller 20*a* and the second drive roller 20*b*. The fine projections may be formed by, for example, thermal spraying in which molten particles are sprayed.

The liquid ejecting apparatus 11 may include a first nip roller 25*a* that presses the medium 12 against the first drive roller 20*a*, and a second nip roller 25*b* that presses the medium 12 against the second drive roller 20*b*. With provision of the first nip roller 25*a*, it is easy to secure a frictional force between the first drive roller 20*a* and the medium 12. With provision of the second nip roller 25*b*, it is easy to secure a frictional force between the second drive roller 20*b* and the medium 12.

The transport portion 14 may include a support drum 27 that is cylindrical and that supports the medium 12. The medium 12 is wound around the support drum 27 while being tensioned, and is supported on the outer peripheral surface of the support drum 27. The support drum 27 may be provided so as to rotate about a rotation shaft 28 extending in the width direction Y. The support drum 27 may be driven to rotate with respect to the medium 12 being transported, or may rotate with the driving of a transport motor (not illustrated) to transport the medium 12.

The medium 12 fed from the feeding portion 13 is supplied to the first driven roller 21, the first drive roller 20*a*, the second driven roller 22, the support drum 27, the third driven roller 23, the second drive roller 20*b*, and the fourth driven roller 24, and sent to the winding portion 16. When the medium 12 is wound around the second driven roller 22 and the third driven roller 23 that are adjacent to the support drum 27 in the transport direction FD, the area supported by the support drum 27 increases.

The winding portion 16 includes a winding shaft 29 extending in the width direction Y. The winding shaft 29 is provided so as to rotate with the driving of a winding motor (not illustrated). The medium 12 is passed through the transport path in advance, and a downstream end of the medium 12 in the transport direction FD is wound around the winding shaft 29. The winding shaft 29 rotates clockwise in FIG. 1 to take up the medium 12. The medium 12 is wound with the printing surface facing outward.

The printing portion 15 includes a first liquid ejecting portion 31 to a sixth liquid ejecting portion 36 that eject liquid to the medium 12 supported by the support drum 27. The first liquid ejecting portion 31 to the sixth liquid ejecting portion 36 have the same configuration, but differ in the type of liquid to be ejected and the inclination with respect to the horizontal plane. The first liquid ejecting portion 31 to the sixth liquid ejecting portion 36 are so-called line heads capable of simultaneously ejecting liquid over the width direction Y of the medium 12. The number of liquid ejecting portions provided in the liquid ejecting apparatus 11 may be one or more. One liquid ejecting portion may eject one kind of liquid, or may eject plural kinds of liquids.

The first liquid ejecting portion 31 to the sixth liquid ejecting portion 36 are disposed along the outer peripheral surface of the support drum 27 in the order of the first liquid ejecting portion 31, the second liquid ejecting portion 32, the third liquid ejecting portion 33, the fourth liquid ejecting portion 34, the fifth liquid ejecting portion 35, and the sixth liquid ejecting portion 36, from upstream in the transport direction FD. The first liquid ejecting portion 31 to the sixth liquid ejecting portion 36 are provided so as to surround the support drum 27 with a gap between the outer peripheral surface of the support drum 27 and the medium 12 passing therethrough.

Examples of the type of liquid include a color ink containing a colorant and a clear ink containing no colorant. Examples of the colors of the color ink include cyan, magenta, yellow, black, white, light magenta, light cyan, light yellow, gray, and orange. Colorants include pigments and dyes, and the type of liquid is determined by the combination thereof with a solvent such as water or a dispersing agent.

The liquid ejecting apparatus 11 may perform color printing on the medium 12 by ejecting a plurality of colors of ink. When printing on the medium 12 in the case where the medium 12 is dark, or the medium 12 in the case where the medium 12 is transparent, if base printing is performed with white ink and then printing is performed with a color ink on the base, printing can be performed with good color.

The first liquid ejecting portion 31 of the present embodiment ejects white ink, which is an example of a liquid. The second liquid ejecting portion 32 ejects cyan ink, which is an example of a liquid. The third liquid ejecting portion 33 ejects magenta ink, which is an example of a liquid. The fourth liquid ejecting portion 34 ejects black ink, which is an example of a liquid. The fifth liquid ejecting portion 35 ejects yellow ink, which is an example of a liquid. The sixth liquid ejecting portion 36 located most downstream in the transport direction FD ejects clear ink, which is an example of a liquid. The liquid ejected by the first liquid ejecting portion 31 to the sixth liquid ejecting portion 36 of the present embodiment is an ultraviolet curable ink that cures by reacting with ultraviolet light.

The first liquid ejecting portion 31 to the sixth liquid ejecting portion 36 have nozzle opening surfaces in which a plurality of nozzles 38 open, and eject the liquid from the nozzles 38 to the medium 12 in a state in which the nozzle opening surfaces are inclined. The extension direction in which a lower end 39 of the nozzle opening surface of each of the first liquid ejecting portion 31 to the sixth liquid ejecting portion 36 extends coincides with the width direction Y.

Specifically, the first liquid ejecting portion 31 has a first nozzle opening surface 41. The first nozzle opening surface 41 faces the medium 12 in an inclined state with respect to the horizontal plane. In the first nozzle opening surface 41, an upstream end in the transport direction FD is located below a downstream end in the direction of gravity Z, and the upstream end is the lower end 39.

A second nozzle opening surface 42 of the second liquid ejecting portion 32, a third nozzle opening surface 43 of the third liquid ejecting portion 33, and a fourth nozzle opening surface 44 of the fourth liquid ejecting portion 34 are inclined in the same manner as the first nozzle opening surface 41, but differ from the first nozzle opening surface 41 in terms of an angle with respect to the horizontal plane. That is, the first nozzle opening surface 41 has a larger inclination with respect to the horizontal plane than the second nozzle opening surface 42. The first nozzle opening surface 41 has a longer distance between the upstream end and the downstream end in the transport direction FD in the direction of gravity Z than the second nozzle opening surface 42. The inclination with respect to the horizontal plane decreases in the order of the first nozzle opening surface 41, the second nozzle opening surface 42, the third nozzle opening surface 43, and the fourth nozzle opening surface 44.

The fifth liquid ejecting portion 35 has a fifth nozzle opening surface 45. The sixth liquid ejecting portion 36 has a sixth nozzle opening surface 46. The fifth nozzle opening surface 45 and the sixth nozzle opening surface 46 face the medium 12 in an inclined state of being inclined with respect to the horizontal plane, but the inclination directions of the first nozzle opening surface 41 to the fourth nozzle opening surface 44 are different. That is, in the fifth nozzle opening surface 45 and the sixth nozzle opening surface 46, the downstream end in the transport direction FD is located below the upstream end in the direction of gravity Z, and the downstream end is the lower end 39. The sixth nozzle opening surface 46 has a larger inclination with respect to the horizontal plane than the fifth nozzle opening surface 45.

Figure 2:
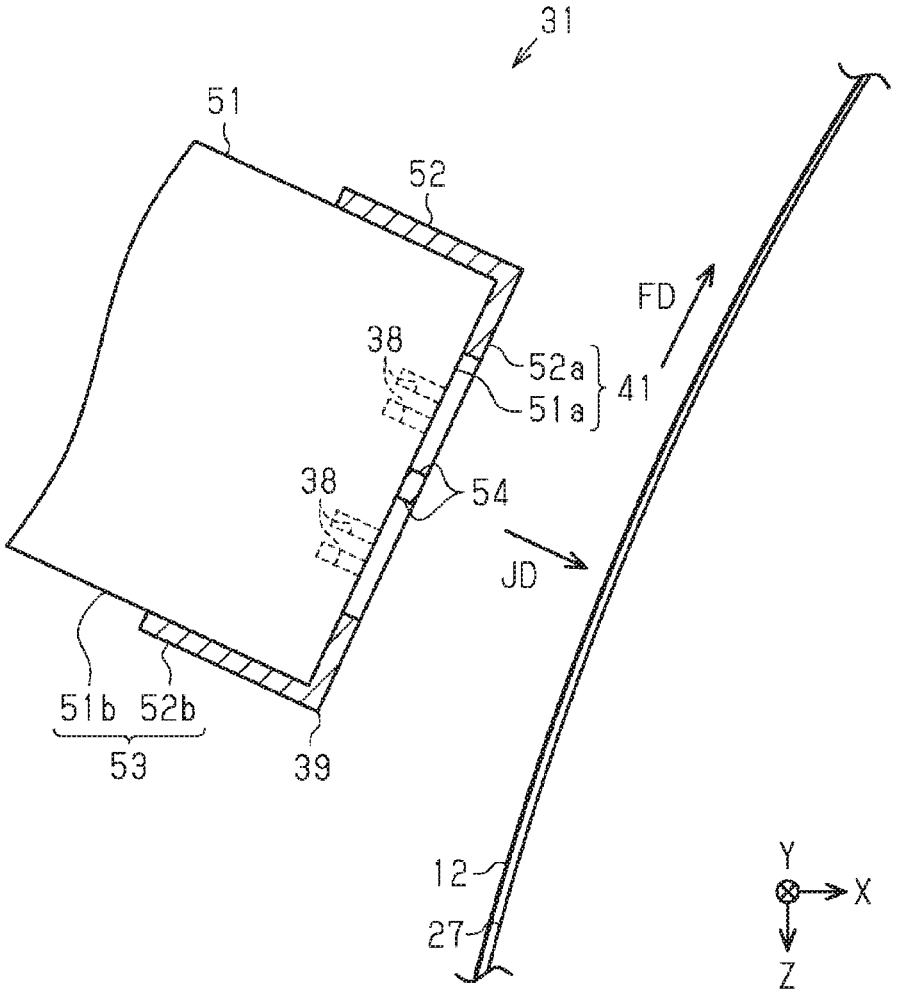
FIG. 2 is a schematic sectional view of a first liquid ejecting portion.

The first to sixth liquid ejecting portions 31 to 36 eject liquid in a direction perpendicular to the nozzle opening surface. Therefore, the first liquid ejecting portion 31 to the sixth liquid ejecting portion 36 have, as illustrated in FIG. 2, different ejection directions JD in which liquid is ejected. The ejection direction JD of the first liquid ejecting portion 31 may be made to coincide with the normal direction at a position where the liquid ejected by the first liquid ejecting portion 31 adheres to the medium 12 supported by the support drum 27. Similarly, the second liquid ejecting portion 32 to the sixth liquid ejecting portion 36 may be provided such that the ejecting direction JD and the normal direction at the position where the liquid is attached coincide.

As illustrated in FIG. 1, the printing portion 15 may include temporary curing lights 48, a first main curing light 49*a*, and a second main curing light 49*b* that irradiate the medium 12 with ultraviolet rays to cure the liquid.

The printing portion 15 may include a plurality of temporary curing lights 48 that may be disposed one by one between each of the first to fifth liquid ejecting portions 31 to 35 in the transport direction FD. The first main curing light 49*a* may be disposed between the fifth liquid ejecting portion 35 and the sixth liquid ejecting portion 36 in the transport direction FD. The second main curing light 49*b* may be disposed between the sixth liquid ejecting portion 36 and the third driven roller 23.

The temporary curing lights 48 irradiate the medium 12 with weak ultraviolet light. The temporary curing lights 48 cure the liquid to such an extent that, for example, the shape of the liquid attached to the medium 12 does not collapse due to transport of the medium 12. The first main curing light 49*a* and the second main curing light 49*b* irradiate ultraviolet rays stronger than the temporary curing lights 48 to fix the liquid on the surface of the medium 12. Specifically, the first main curing light 49*a* fixes an image printed with the color ink ejected by the first liquid ejecting portion 31 to the fifth liquid ejecting portion 35. The second main curing light 49*b* fixes the clear ink ejected by the sixth liquid ejecting portion 36 and coats the image.

Next, the first liquid ejecting portion 31 will be described.

As illustrated in FIG. 2, the first liquid ejecting portion 31 may include a nozzle forming member 51 that has a holding portion that holds one or a plurality of nozzle units in which the nozzles 38 are formed, and a cover member 52 that covers a portion of the nozzle forming member 51. The first liquid ejecting portion 31 may have a lower side surface 53 that intersects the first nozzle opening surface 41 at the lower end 39.

In the nozzle forming member 51, the nozzle unit has an exposed surface 51*a* where the nozzles 38 open, and the holding portion has a main body side surface 51*b* that is continuous from the holding surface that holds the nozzle unit on the exposed surface 51*a* side. The cover member 52 has a cover bottom surface 52*a* having through holes 54 that expose the exposed surface 51*a*, and a cover side surface 52*b* that is continuous from the cover bottom surface 52*a*. The lower side surface 53 includes the main body side surface 51*b* and the cover side surface 52*b*. In other words, the main body side surface 51*b* and the cover side surface 52*b* each form a portion of the lower side surface 53.

The cover member 52 is formed of, for example, a metal such as stainless steel. The cover member 52 covers the side of the nozzle forming member 51 where the nozzles 38 are formed so that the nozzles 38 are exposed from the through holes 54. The cover member 52 may expose all the nozzles 38 from one through hole 54, or may have a plurality of through holes 54 and have one through hole 54 expose some of the nozzles 38.

The first nozzle opening surface 41 may be formed by the exposed surface 51*a* exposed from the through hole 54 and the cover bottom surface 52*a*. The liquid repellency of the cover bottom surface 52*a* to the liquid may be lower than the liquid repellency of the exposed surface 51*a* to the liquid. The liquid repellency of the cover side surface 52*b* to the liquid may be lower than the liquid repellency of the cover bottom surface 52*a* to the liquid.

Figure 3:
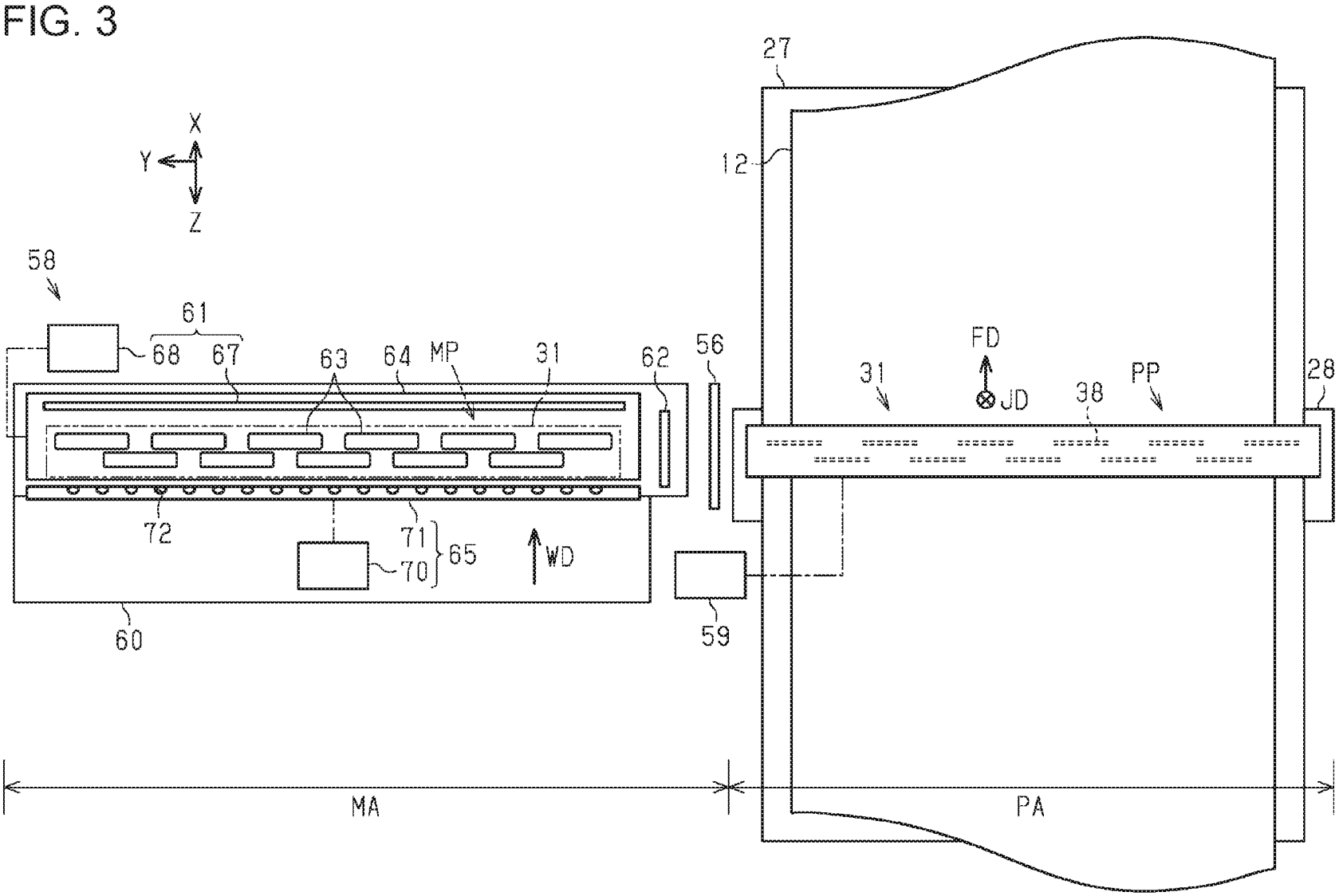
FIG. 3 is a schematic diagram of the first liquid ejecting portion and a maintenance unit.

As illustrated in FIG. 3, the liquid ejecting apparatus 11 has a printing area PA in which the liquid is ejected to the medium 12, and a maintenance area MA adjacent to the printing area PA in the width direction Y. The liquid ejecting apparatus 11 may include a blocking plate 56 that blocks ultraviolet rays, and the printing area PA and the maintenance area MA may be separated by the blocking plate 56. The printing area PA is an area closer to the support drum 27 than the blocking plate 56 in the width direction Y. The maintenance area MA is an area opposite to the support drum 27 with respect to the blocking plate 56.

The liquid ejecting apparatus 11 includes maintenance units 58 provided in the maintenance area MA. Six maintenance units 58 are provided corresponding to the first liquid ejecting portion 31 to the sixth liquid ejecting portion 36, respectively, but have the same configuration. Therefore, in the drawings, the maintenance unit 58 corresponding to the first liquid ejecting portion 31 is illustrated, and illustration of the maintenance units 58 corresponding to the second liquid ejecting portion 32 to the sixth liquid ejecting portion 36 is omitted.

The liquid ejecting apparatus 11 may include a liquid ejecting portion moving mechanism 59 that moves the first liquid ejecting portion 31. The liquid ejecting portion moving mechanism 59 may move the first liquid ejecting portion 31 to the sixth liquid ejecting portion 36 collectively or individually.

The maintenance unit 58 includes a case 60, a first cleaning portion 61, a second cleaning portion 62, caps 63, a support portion 64 that supports the caps 63, and a wiping liquid supply mechanism 65.

The first cleaning portion 61 has a wiping member 67 that can wipe the first nozzle opening surface 41 and a wiping member moving mechanism 68 that moves the wiping member 67. The wiping member 67 is supported by the support portion 64. The wiping member moving mechanism 68 reciprocates the caps 63 and the wiping member 67 in a wiping direction WD and in a direction opposite to the wiping direction WD by moving the support portion 64. The second cleaning portion 62 is disposed on the case 60 so as to be fixed.

The wiping liquid supply mechanism 65 includes a storage portion 70 that stores a wiping liquid, and a supply pipe 71 coupled to the storage portion 70, and injects the wiping liquid from supply ports 72 formed in the supply pipe 71. A plurality of supply ports 72 disposed in the width direction Y may be formed in the supply pipe 71.

As the wiping liquid, pure water may be employed, or a liquid obtained by adding an additive to pure water may be employed. Examples of additives include, for example, resins, preservatives, defoamers, humectants, penetrants, surfactants, organic solvents, pH adjusters, and the like. Each of the above components may be used alone or in a combination of two or more, and the content thereof is not particularly limited. When the liquid ejected by the first liquid ejecting portion 31 is an ultraviolet curable ink, a solvent capable of dissolving the cured ink may be used as the wiping liquid, or a transparent ultraviolet curable ink may be used as the wiping liquid. Examples of the solvent capable of dissolving the ultraviolet curable ink include ethyl diglycol acetate (EDGAC), and a surfactant or a polymerization inhibitor may be added to the solvent.

The liquid ejecting portion moving mechanism 59 reciprocates the first liquid ejecting portion 31 in the width direction Y and in a direction opposite to the width direction Y. The first liquid ejecting portion 31 moves in the width direction Y from a printing position PP indicated by the solid line in FIG. 3 in the printing area PA, and reaches a maintenance position MP in the maintenance area MA, which is indicated by the two-dot chain line in FIG. 3.

Figure 4:
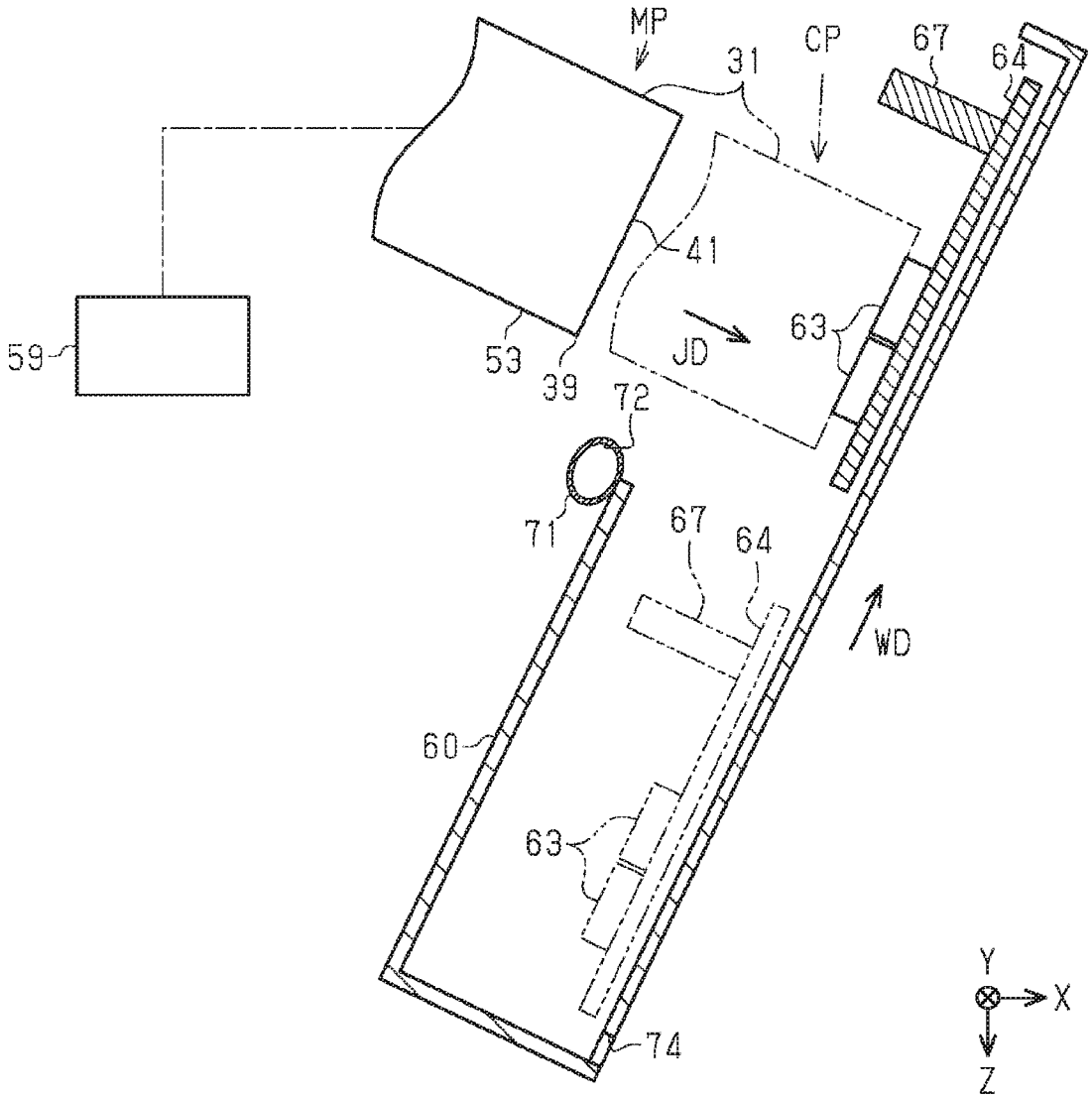
FIG. 4 is a schematic sectional view of the first liquid ejecting portion and the maintenance unit.

As illustrated in FIG. 4, the case 60 may be provided with a discharge port 74. If the discharge port 74 is provided at the lower end in the direction of gravity Z, the liquid can be made less likely to remain in the case 60.

The liquid ejecting portion moving mechanism 59 reciprocates the first liquid ejecting portion 31 located at the maintenance position MP in an ejection direction JD and a direction opposite to the ejection direction JD. The first liquid ejecting portion 31 moves in the ejection direction JD from the maintenance position MP indicated by the solid line in FIG. 4 and reaches a capping position CP indicated by the two-dot chain line in FIG. 4. The first liquid ejecting portion 31 located at the capping position CP is capped by the caps 63.

Figure 5:
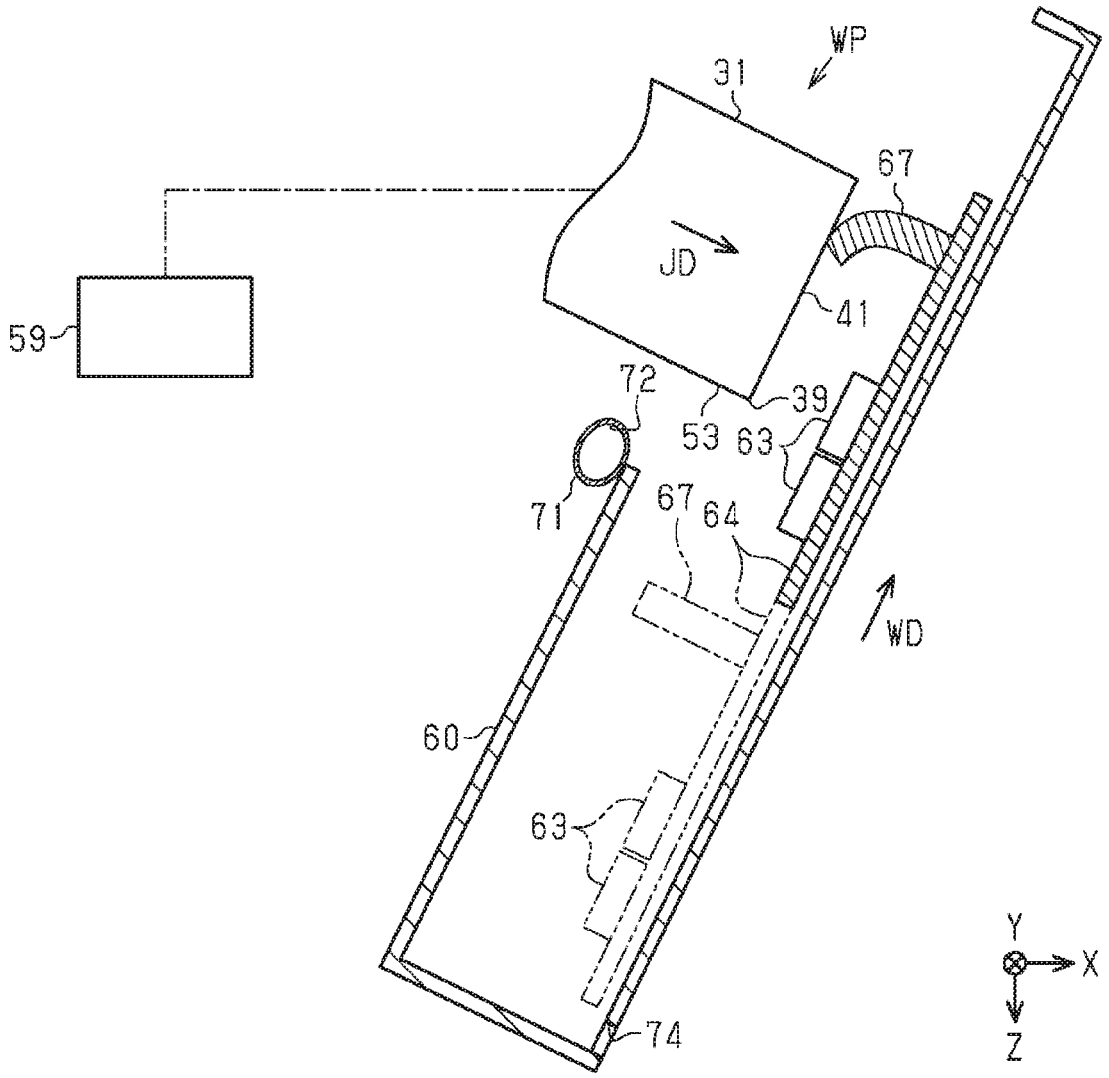
FIG. 5 is a schematic sectional view of the first liquid ejecting portion and the maintenance unit.

As illustrated in FIG. 5, the liquid ejecting portion moving mechanism 59 may position the first liquid ejecting portion 31 at the wiping position WP. The wiping position WP is a position between the maintenance position MP and the capping position CP in the ejection direction JD. The lower side surface 53 of the first liquid ejecting portion 31 located at the wiping position WP faces the supply ports 72 for the wiping liquid. Therefore, the wiping liquid supply mechanism 65 is provided so as to be able to supply the wiping liquid to the lower side surface 53 of the first liquid ejecting portion 31 in an inclined state.

The wiping member moving mechanism 68 moves the wiping member 67 in the wiping direction WD, which is an example of an inclination direction, in a state in which the first liquid ejecting portion 31 is located at the wiping position WP. The wiping direction WD in the present embodiment is a direction along the first nozzle opening surface 41 inclined with respect to the horizontal plane. The wiping member 67 wipes the first nozzle opening surface 41, which is inclined, upward from below by moving in the wiping direction WD.

Next, the second cleaning portion 62 will be described.

A plurality of second cleaning portions 62 are provided so as to individually correspond to the first liquid ejecting portion 31 to the sixth liquid ejecting portion 36. Since the plurality of second cleaning portions 62 are disposed in accordance with the inclinations of the first liquid ejecting portion 31 to the sixth liquid ejecting portion 36, they have substantially the same configuration, although their inclinations with respect to the horizontal plane are different. Therefore, the second cleaning portion 62 corresponding to the first liquid ejecting portion 31 will be described, and the description of the second cleaning portions 62 corresponding to the second liquid ejecting portion 32 to the sixth liquid ejecting portion 36 will be omitted.

Figure 6:
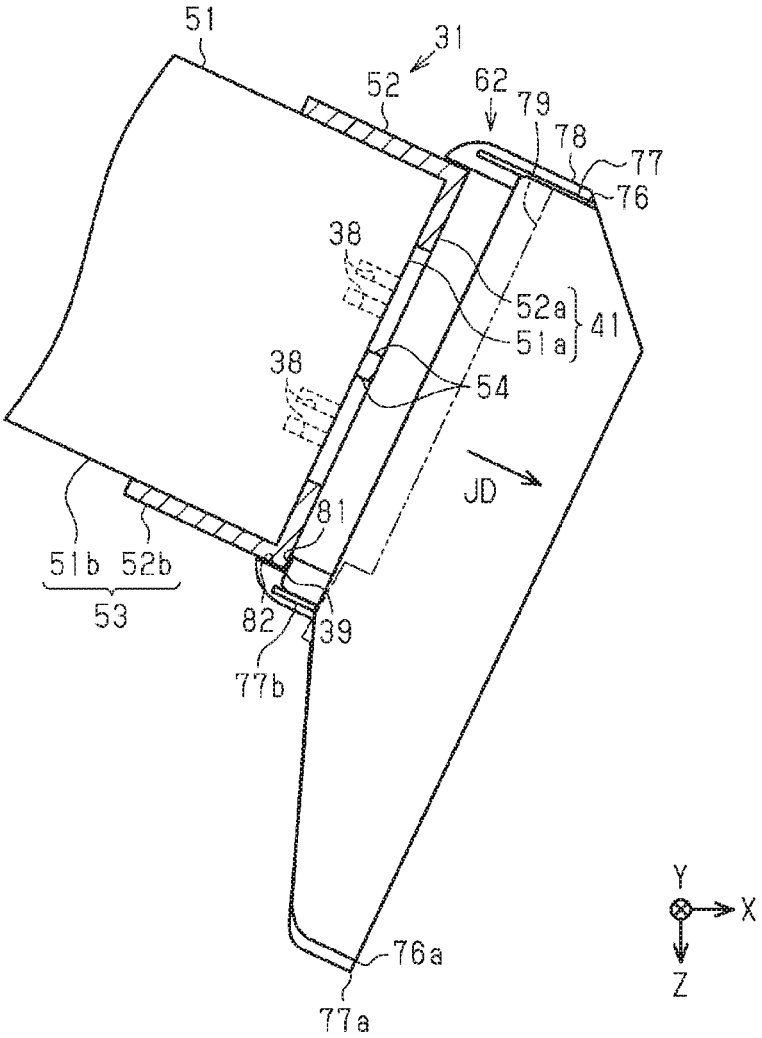
FIG. 6 is a schematic front view of the first liquid ejecting portion and a second cleaning portion.

As illustrated in FIG. 6, the second cleaning portion 62 includes an end portion cleaning member 76 formed of an absorbing member capable of absorbing liquid. The second cleaning portion 62 may include a guide member 77 formed of a plate-like member that does not absorb liquid, and a side surface cleaning member 78 formed of an absorbing member. The end portion cleaning member 76 and the side surface cleaning member 78 may be formed by the same absorbing member. The absorbing member may be formed of non-absorbing fibers into which liquid is hardly drawn. When the absorbing member draws and absorbs the liquid into gaps between the fibers by capillary force, the liquid once absorbed is easily discharged. For example, Micloth (registered trademark) produced by OJI KINOCLOTH CO., LTD. may be used as the absorbing member.

Figure 7:
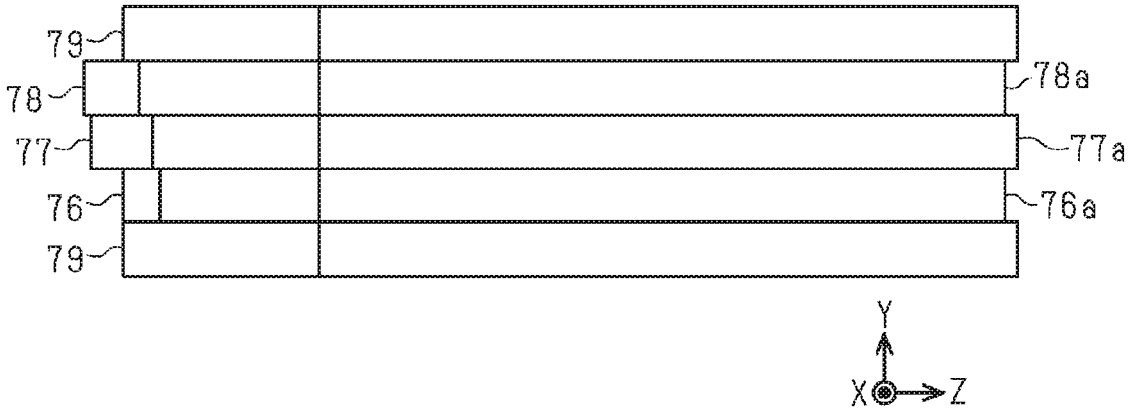
FIG. 7 is a schematic view of the second cleaning portion viewed from a horizontal direction.

As illustrated in FIG. 7, the end portion cleaning member 76 may be provided at a position closer to the printing area PA than the side surface cleaning member 78 in the maintenance area MA.

The end portion cleaning member 76 has a first lower end portion 76*a*, which is a lower end of the end portion cleaning member 76. The side surface cleaning member 78 has a second lower end portion 78*a*, which is a lower end of the side surface cleaning member 78. The guide member 77 has a third lower end portion 77*a*, which is a lower end of the guide member 77.

The guide member 77 may be held while being interposed between the end portion cleaning member 76 and the side surface cleaning member 78. The guide member 77 is interposed between the end portion cleaning member 76 and the side surface cleaning member 78, and the third lower end portion 77*a* of the guide member 77 may be located below the first lower end portion 76*a* of the end portion cleaning member 76 and the second lower end portion 78*a* of the side surface cleaning member 78.

The second cleaning portion 62 may include a pair of pressing members 79 for pressing the end portion cleaning member 76, the guide member 77, and the side surface cleaning member 78 from outside the end portion cleaning member 76 and the side surface cleaning member 78. The guide member 77 and the pressing members 79 are formed of metal such as stainless steel, and have a higher rigidity than the end portion cleaning member 76 and the side surface cleaning member 78.

The pressing members 79 may be provided in a state in which the end portion cleaning member 76 and the side surface cleaning member 78 are compressed. That is, in the end portion cleaning member 76 and the side surface cleaning member 78, portions interposed between the guide member 77 and the pressing member 79 are compressed to have a high capillary force, whereas uncompressed portions have a low capillary force.

As illustrated in FIG. 6, in the end portion cleaning member 76, a first contact portion 81 that contacts the first nozzle opening surface 41, and, in the side surface cleaning member 78, a second contact portion 82 that contacts the lower side surface 53 do not have to be interposed between the guide member 77 and the pressing member 79. Accordingly, the liquid absorbed by the first contact portion 81 and the second contact portion 82 can be easily moved to portions interposed between the guide member 77 and the pressing member 79. The guide member 77 may include a support portion 77*b* that supports the second contact portion 82.

Figure 8:
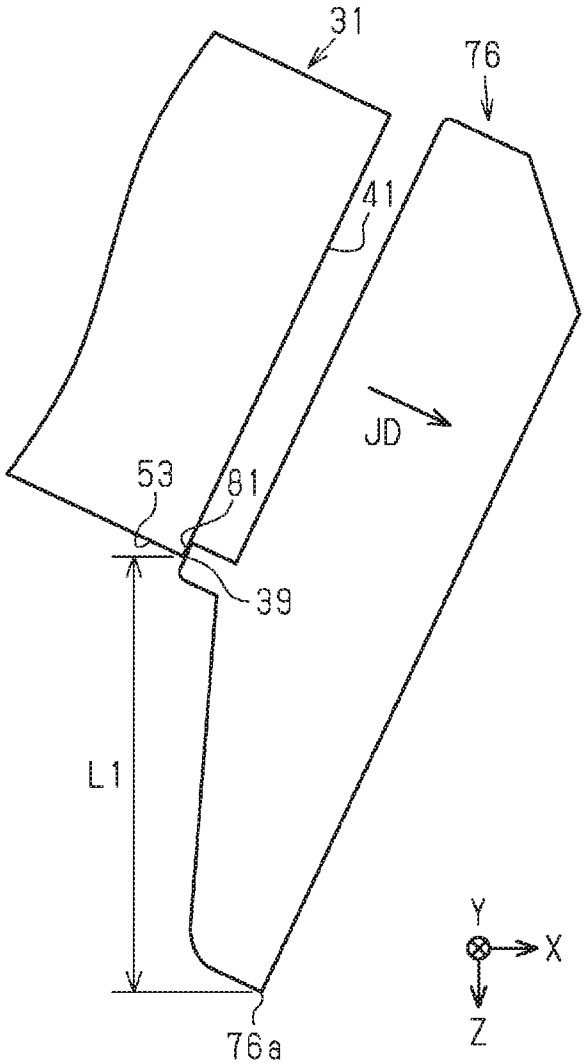
FIG. 8 is a schematic front view of an end portion cleaning member included in the second cleaning portion.

As illustrated in FIG. 8, in the end portion cleaning member 76, the distance in the direction of gravity Z from the first contact portion 81 to the first lower end portion 76*a* is referred to as a first distance L1. When the end portion cleaning member 76 is in contact with the first liquid ejecting portion 31, the distance from the lower end 39 to the first lower end portion 76*a* in the direction of gravity Z is equal to the first distance L1. The first distance L1 is longer than a height at which the absorbing member forming the end portion cleaning member 76 sucks up the liquid in the direction of gravity Z.

Figure 9:
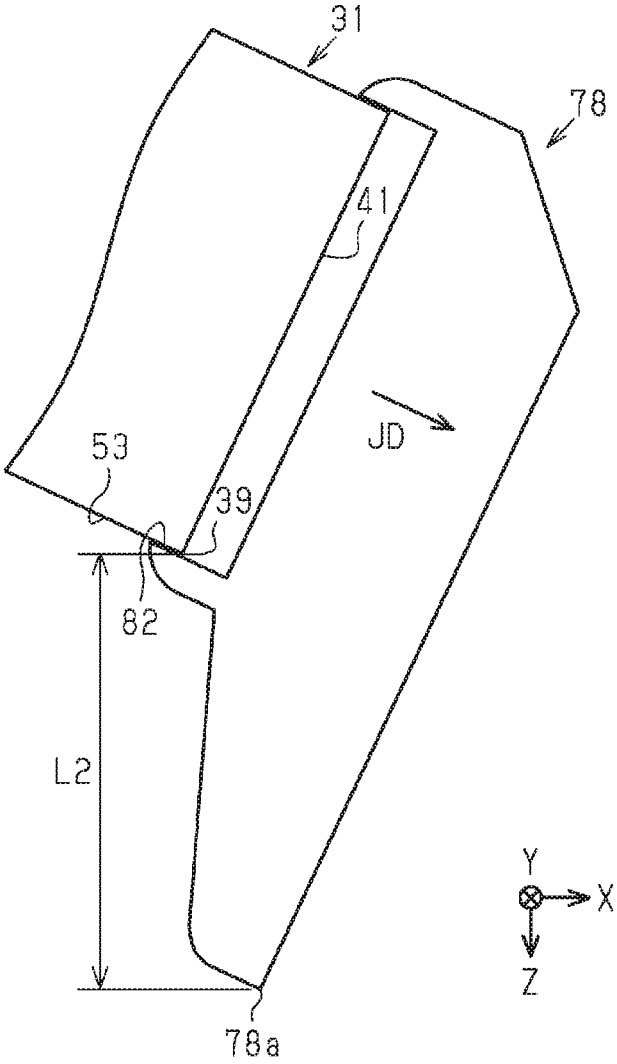
FIG. 9 is a schematic front view of a side surface cleaning member included in the second cleaning portion.

As illustrated in FIG. 9, a distance in the direction of gravity Z from the second contact portion 82 that contacts the lower side surface 53 to the second lower end portion 78*a* in the side surface cleaning member 78 is referred to as a second distance L2. When the side surface cleaning member 78 is in contact with the first liquid ejecting portion 31, the distance in the direction of gravity Z from the lower end 39 to the second lower end portion 78*a* is equal to the second distance L2. The second distance L2 is longer than a height at which the absorbing member forming the side surface cleaning member 78 sucks up the liquid in the direction of gravity Z.

The operation of the present embodiment will be described.

As illustrated in FIG. 3, when performing maintenance on the first liquid ejecting portion 31, the liquid ejecting portion moving mechanism 59 moves the first liquid ejecting portion 31 located in the printing area PA to the maintenance area MA. At this time, the second cleaning portion 62 may wipe the first liquid ejecting portion 31 or may withdraw so as not to contact the first liquid ejecting portion 31.

As illustrated in FIG. 5, the first liquid ejecting portion 31 that has moved to the maintenance area MA further moves in the ejection direction JD and is located at the wiping position WP. The wiping liquid supply mechanism 65 supplies the wiping liquid toward the lower side surface 53 of the first liquid ejecting portion 31 located at the wiping position WP. The wiping liquid supplied to the lower side surface 53 moves downward due to gravity and tends to accumulate at the lower end 39.

Subsequently, the first cleaning portion 61 moves the wiping member 67 in the wiping direction WD to wipe the first nozzle opening surface 41. That is, the wiping member 67 may wipe the first nozzle opening surface 41 upward from the lower end 39 by moving relative to the first liquid ejecting portion 31 in a state of being in contact with the first nozzle opening surface 41.

As illustrated in FIG. 6, the liquid ejecting portion moving mechanism 59 moves the first liquid ejecting portion 31 having the first nozzle opening surface 41 wiped from the maintenance area MA to the printing area PA. At this time, the second cleaning portion 62 may wipe the first liquid ejecting portion 31. In other words, the wiping of the lower end 39 by the end portion cleaning member 76 and the wiping of the lower side surface 53 by the side surface cleaning member 78 may be performed by the movement of the first liquid ejecting portion 31 from the maintenance area MA toward the printing area PA.

The end portion cleaning member 76 is configured to collect liquid by wiping the lower end 39 by relatively moving in the width direction Y with respect to the first liquid ejecting portion 31 in a state in which the end portion cleaning member 76 contacts the lower end 39 of the first nozzle opening surface 41 in an inclined state from below. The side surface cleaning member 78 is configured to wipe the lower side surface 53 by relatively moving in the width direction Y with respect to the first liquid ejecting portion 31 in a state of being in contact with the lower side surface 53 from below.

The liquid absorbed by the end portion cleaning member 76 and the side surface cleaning member 78 is guided by the guide member 77 and discharged from the end portion cleaning member 76 and the side surface cleaning member 78. The discharged liquid may be received by the case 60. The liquid received by the case 60 is discharged from the case 60 through the discharge port 74.

The effect of the present embodiment will be described.

1. The first cleaning portion 61 configured to wipe the first nozzle opening surface 41 and the second cleaning portion 62 configured to wipe the lower end 39 of the first nozzle opening surface 41 in order to absorb liquid are provided. Therefore, liquid that cannot be wiped off by the wiping by the first cleaning portion 61 or liquid that adheres to the first nozzle opening surface 41 during printing can be wiped by the second cleaning portion 62 even if the liquid accumulates near the lower end 39 of the first nozzle opening surface 41. Therefore, the likelihood of liquid that has adhered to the first nozzle opening surface 41 coming into contact with the medium 12 can be reduced, and a decrease in print quality can be suppressed.

2. The first nozzle opening surface 41 can be wiped by moving the wiping member 67 in the wiping direction WD with respect to the first nozzle opening surface 41, which is inclined. Then, the end portion cleaning member 76 moves relative to the first liquid ejecting portion 31 in the width direction Y. Therefore, even if the liquid cannot be wiped by the wiping member 67 and remains on the first nozzle opening surface 41, the liquid can be collected by wiping the lower end 39 of the first nozzle opening surface 41 with the end portion cleaning member 76, which is smaller than the first nozzle opening surface 41 in the width direction Y.

3. The second cleaning portion 62 has the side surface cleaning member 78 that wipes the lower side surface 53 of the first liquid ejecting portion 31. Therefore, for example, even when liquid scattered during printing adheres to the lower side surface 53, the liquid can be wiped off by the side surface cleaning member 78. Therefore, the likelihood of liquid that has adhered to the lower side surface 53 coming into contact with the medium 12 can be reduced.

4. The end portion cleaning member 76 and the side surface cleaning member 78 are formed of absorbing members capable of absorbing liquid. In the end portion cleaning member 76 and the side surface cleaning member 78, the first distance L1 and the second distance L2, which are the distances from the portion where the first liquid ejecting portion 31 is wiped to the lower end, are longer than a height at which the absorbing member absorbs the liquid. Therefore, the liquid absorbed in the first contact portion 81 and the second contact portion 82 is likely to accumulate on the first lower end portion 76*a* and the second lower end portion

78*a* due to gravity, and can be made less likely to stay on the first contact portion 81 and the second contact portion 82.

5. The end portion cleaning member 76 and the side surface cleaning member 78 interpose the guide member 77. That is, the end portion cleaning member 76 and the side surface cleaning member 78 are in contact with the guide member 77. Because the third lower end portion 77*a* of the guide member 77 is located below the end portion cleaning member 76 and the side surface cleaning member 78, the liquid absorbed by the end portion cleaning member 76 and the side surface cleaning member 78 can be easily released from the end portion cleaning member 76 and the side surface cleaning member 78.

6. The end portion cleaning member 76 and the side surface cleaning member 78 wipe the first liquid ejecting portion 31 by the movement of the first liquid ejecting portion 31 from the maintenance area MA toward the printing portion 15. That is, because the first liquid ejecting portion 31 moves to the print area PA in a state in which liquid that has attached to the lower end 39 and the lower side surface 53 of the first nozzle opening surface 41 has been wiped off, the risk of soiling the medium 12 located in the print area PA can be reduced.

7. The wiping liquid supplied to the lower side surface 53 by the wiping liquid supply mechanism 65 is likely to accumulate at the lower end 39 of the first nozzle opening surface 41 intersecting with the lower side surface 53. The wiping member 67 wipes the first nozzle opening surface 41 upward from the lower end 39. Therefore, the first nozzle opening surface 41 can be wiped using the wiping liquid, and the cleaning effect of the first nozzle opening surface 41 can be enhanced. The wiping liquid remaining on the first nozzle opening surface 41 and the lower side surface 53 can be wiped by the second cleaning portion 62.

8. In the cover bottom surface 52*a* and the exposed surface 51*a* forming the first nozzle opening surface 41, the liquid repellency of the cover bottom surface 52*a* is lower than the liquid repellency of the exposed surface 51*a*. Therefore, the liquid adhering to the exposed surface 51*a* easily moves to the cover bottom surface 52*a*, and the liquid is less likely to remain on the exposed surface 51*a*. Therefore, even when the first nozzle opening surface 41 has irregularities, the first nozzle opening surface 41 can be easily wiped.

9. The liquid repellency of the cover side surface 52*b* is lower than the liquid repellency of the cover bottom surface 52*a*. Therefore, for example, even when the liquid adheres to the cover bottom surface 52*a* during printing, the liquid easily moves to the cover side surface 52*b*. Therefore, the likelihood of liquid that has adhered to the cover bottom surface 52*a* coming into contact with the medium 12 can be reduced.

This embodiment can be implemented with the following modifications. The present embodiment and the following modifications can be implemented in combination with each other to the extent that they do not conflict technically.

Figure 10:
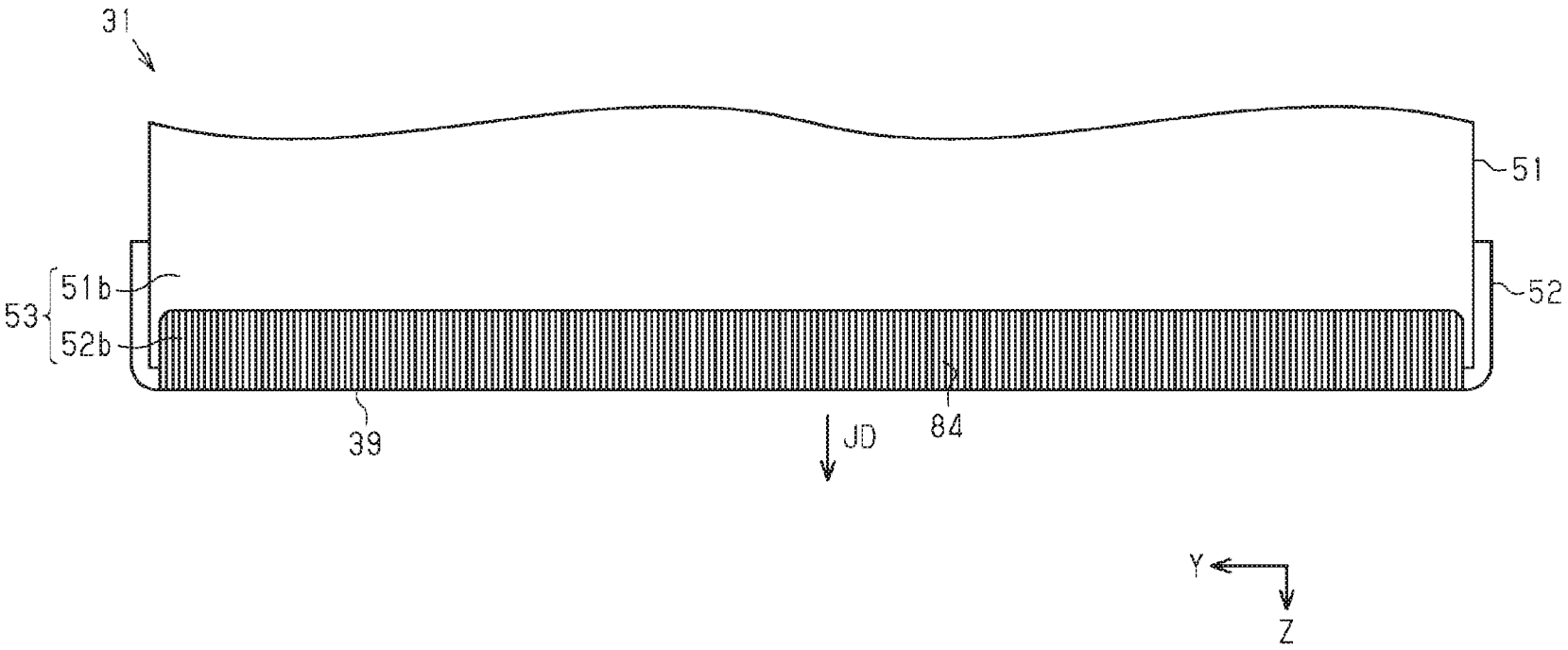
FIG. 10 is a schematic diagram of a first liquid ejecting portion according to a modification.
Figure 11:
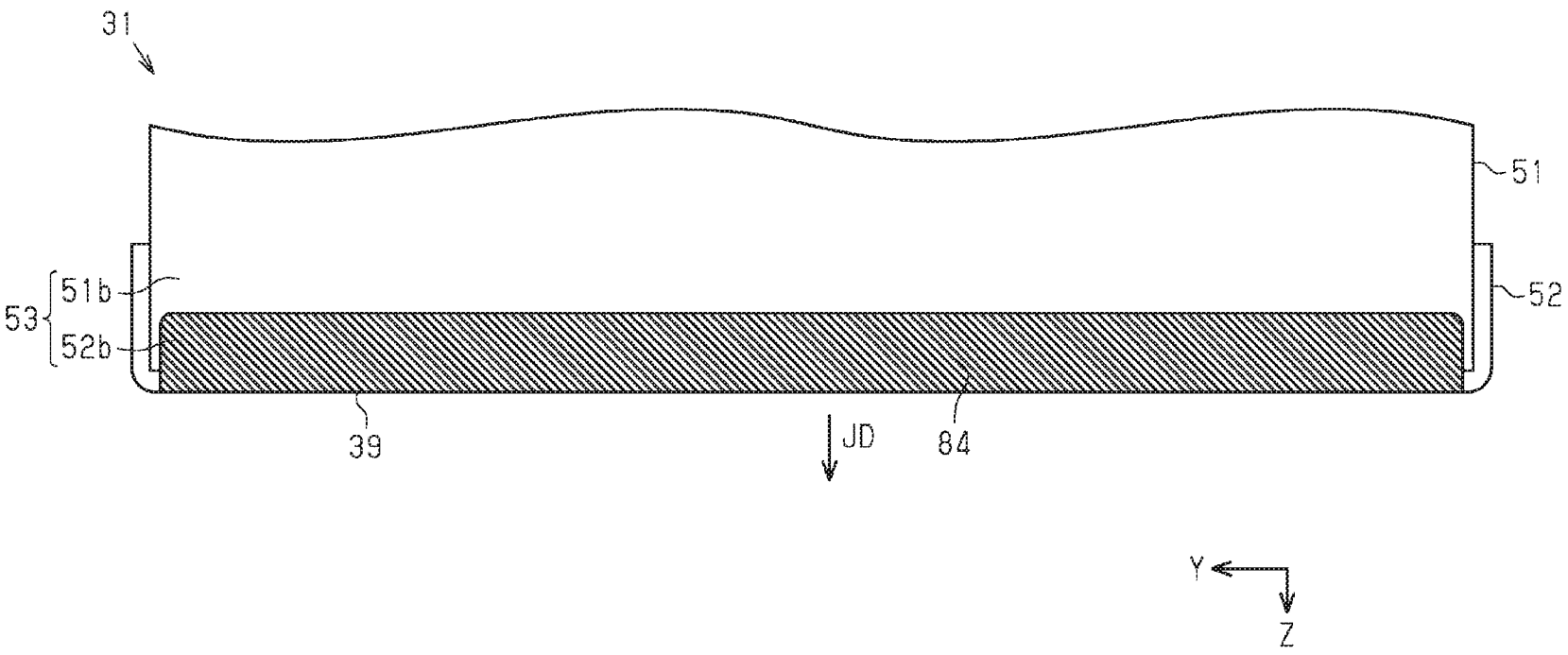
FIG. 11 is a schematic view of the first liquid ejecting portion according to the modification.

As illustrated in FIGS. 10 and 11, narrow grooves 84, also called hairlines, may be formed on the cover side surface 52*b*. When the narrow grooves 84 are formed so as to extend in the direction of gravity Z as illustrated in FIG. 10, the liquid attached to the first nozzle opening surface 41 and accumulated at the lower end 39 can be pulled up toward the upper end of the cover side surface 52*b*. The narrow grooves 84 may be formed diagonally to the direction of gravity Z as illustrated in FIG. 11. When the side surface cleaning member 78 wipes the cover side surface 52*b*, the narrow grooves 84 are inclined such that a first end of the narrow grooves 84 that first passes through the side surface cleaning member 78 is located below a second end that passes through the side surface cleaning member 78 in the direction of gravity Z. With such an inclination, liquid accumulated at the lower end 39 can be easily pulled up toward the upper end of the cover side surface 52*b* by the wiping action of the side surface cleaning member 78. The upper end of the cover side surface 52*b* may be located lower than the upper end of the second contact portion 82, and the liquid that has climbed the cover side surface 52*b* may be wiped by the side surface cleaning member 78.

The inclination of the first liquid ejecting portion 31 to the sixth liquid ejecting portion 36 with respect to the horizontal plane may be different between when printing and when maintenance is performed. For example, the first liquid ejecting portion 31 may print on the medium 12 in a state in which the first nozzle opening surface 41 is inclined with respect to the horizontal plane, and the first nozzle opening surface 41 and the lower end 39 may be wiped in a horizontal state in which the first nozzle opening surface 41 is parallel to a horizontal plane.

In the width direction Y, the length of the end portion cleaning member 76 may be longer than the length of the lower end 39. In this case, the end portion cleaning member 76 does not have to move relatively to the first liquid ejecting portion 31 while being in contact with the lower end 39. That is, the first liquid ejecting portion 31 and the end portion cleaning member 76 may be relatively moved so that the end portion cleaning member 76 is located at a position where the end portion cleaning member 76 contacts the lower end 39 and at a position away from the lower end 39. The end portion cleaning member 76 may contact the lower end 39 to absorb the liquid. Similarly, the length of the side surface cleaning member 78 may be equal to or greater than the length of the lower side surface 53, and the side surface cleaning member 78 may contact the lower side surface 53 to absorb the liquid.

The end portion cleaning member 76 and the side surface cleaning member 78 may be formed integrally. The second cleaning portion 62 need not include the guide member 77, or may cause the pressing member 79 to function as a guide member.

Portions of the end portion cleaning member 76 and the side surface cleaning member 78 may be in contact with the case 60, respectively. For example, the first lower end portion 76*a* of the end portion cleaning member 76 may be brought into contact with the case 60. The second lower end portion 78*a* of the side surface cleaning member 78 may be brought into contact with the case 60. Thus, the liquid absorbed by the end portion cleaning member 76 and the side surface cleaning member 78 can be easily discharged from the end portion cleaning member 76 and the side surface cleaning member 78.

The cover side surface 52*b* may be subjected to a lyophilic treatment to reduce the liquid repellency. By making the lyophilic property of the cover side surface 52*b* higher than the lyophilic property of the cover bottom surface 52*a*, the liquid accumulated at the lower end 39 can be easily pulled up to the cover side surface 52*b*.

The first liquid ejecting portion 31 may integrally form the nozzle forming member 51 and the cover member 52.

The liquid repellency of the cover side surface 52*b* to the liquid may be the same as or higher than the liquid repellency of the cover bottom surface 52*a* to the liquid.

The liquid repellency of the cover bottom surface 52*a* to the liquid may be the same as the liquid repellency of the exposed surface 51*a* to the liquid, or may be higher.

The wiping liquid supply mechanism 65 may supply the wiping liquid to the second cleaning portion 62. The second cleaning portion 62 may wipe the first liquid ejecting portion 31 with the end portion cleaning member 76 and the side surface cleaning member 78 impregnated with the wiping liquid.

The first cleaning portion 61 may wipe the first nozzle opening surface 41 by moving the wiping member 67 downward from above. The first cleaning portion 61 may wipe the first nozzle opening surface 41 by moving the wiping member 67 in the width direction Y.

The liquid ejecting portion moving mechanism 59 relatively moves the wiping member 67 and the first liquid ejecting portion 31 by moving the first liquid ejecting portion 31 in the wiping direction WD, and the first nozzle opening surface 41 may be wiped by the wiping member 67.

The wiping of the lower end 39 by the end portion cleaning member 76 and the wiping of the lower side surface 53 by the side surface cleaning member 78 may be performed by moving the first liquid ejecting portion 31 from the printing area PA to the maintenance area MA. The wiping of the lower end 39 by the end portion cleaning member 76 and the wiping of the lower side surface 53 by the side surface cleaning member 78 may be performed at different timings. For example, when the first liquid ejecting portion 31 moves from the printing area PA to the maintenance area MA, the lower side surface 53 may be wiped by the side surface cleaning member 78, and when the first liquid ejecting portion 31 moves from the maintenance area MA to the printing area PA, the lower end 39 may be wiped by the end portion cleaning member 76.

The end portion cleaning member 76 may be provided at a position farther from the printing area PA than the side surface cleaning member 78 in the maintenance area MA.

The liquid ejecting apparatus 11 may move the first liquid ejecting portion 31 and the second cleaning portion 62 relatively by moving the second cleaning portion 62.

The third lower end portion 77*a* of the guide member 77 may be located at the same position in the direction of gravity Z as the first lower end portion 76*a* of the end portion cleaning member 76 and the second lower end portion 78*a* of the side surface cleaning member 78, or the third lower end portion 77*a* of the guide member 77 may be located above the first lower end portion 76*a* and the second lower end portion 78*a*.

The first distance L1 of the end portion cleaning member 76 may be equal to or shorter than a height at which the absorbing member sucks up the liquid in the direction of gravity Z. The second distance L2 of the side surface cleaning member 78 may be equal to or shorter than a height at which the absorbing member sucks up the liquid in the direction of gravity Z.

The second cleaning portion 62 may include at least the end portion cleaning member 76 of the end portion cleaning member 76 and the side surface cleaning member 78. That is, the second cleaning portion 62 does not need to wipe the lower side surface 53.

The liquid ejecting apparatus 11 may be a liquid ejecting apparatus that ejects or discharges a liquid other than ink. The liquid discharged as a minute amount of liquid droplets from the liquid ejecting apparatus may have any of a grain shape, a teardrop shape, and a thread-like tail shape. The liquid referred to here may be any material as long as it can be ejected from the liquid ejecting apparatus. For example, the material may have any state as long as the substance is in a liquid phase, and it may be a liquid material having high or low viscosity, a sol, gel water, another inorganic solvent, an organic solvent, a solution, a liquid resin, a liquid metal, or a metal melt. Not only a liquid as one state of a substance, but also substances in which particles of a functional material composed of a solid material such as pigments and metal particles are dissolved, dispersed or mixed in a solvent, and the like are included. Representative examples of the liquid include ink, liquid crystals, and the like as described in the above embodiment. Here, examples of "ink" include various types of liquid compositions such as general water-based ink and oil-based ink, gel ink, hot melt ink and the like. A specific example of the liquid ejecting apparatus is a liquid ejecting apparatus that ejects a liquid containing dispersed or dissolved materials such as electrode materials and coloring materials used for manufacturing liquid crystal displays, electroluminescence displays, surface emitting displays, color filters, and the like. The liquid ejecting apparatus may be a liquid ejecting apparatus that ejects a bioorganic material used for biochip production, a liquid ejecting apparatus that is used as a precision pipette and ejects a liquid as a sample, a textile printing apparatus, a microdispenser, or the like. The liquid ejecting apparatus may be a liquid ejecting apparatus that ejects lubricating oil with pinpoint accuracy to a precision machine such as a watch or a camera, or a liquid ejecting apparatus that ejects a transparent resin liquid such as an ultraviolet curable resin liquid onto a substrate to form a micro hemispherical lens, an optical lens, or the like used for an optical communication element or the like. The liquid ejecting apparatus may be a liquid ejecting apparatus that ejects an etching solution such as an acid or an alkali to etch a substrate or the like.

The technical ideas grasped from the embodiment and the modifications described above and the operation effects thereof are described below.

A. A liquid ejecting apparatus includes a liquid ejecting portion that has a nozzle opening surface on which a plurality of nozzles open, and that ejects a liquid from the nozzles to a medium in an inclined state in which the nozzle opening surface is inclined, a first cleaning portion that has a wiping member configured to wipe the nozzle opening surface by moving relative to the liquid ejecting portion in a state of being in contact with the nozzle opening surface, and a second cleaning portion that is formed of an absorbing member configured to absorb the liquid and that has an end portion cleaning member configured to wipe a lower end of the nozzle opening surface in the inclined state by moving relative to the liquid ejecting portion in a state of being in contact with the lower end.

According to this configuration, the first cleaning portion configured to wipe the nozzle opening surface and the second cleaning portion configured to wipe the lower end of the nozzle opening surface and configured to absorb the liquid are provided. Therefore, even if liquid that cannot be wiped off by the first cleaning portion or liquid that adheres to the nozzle opening surface during printing accumulates near the lower end of the nozzle opening surface, the liquid can be wiped off by the second cleaning portion. Therefore, the likelihood of liquid that has adhered to the nozzle opening surface coming into contact with the medium can be reduced, and a decrease in print quality can be suppressed.

B. In the liquid ejecting apparatus, the wiping member may wipe the nozzle opening surface in the inclined state by moving in an inclination direction, and the end portion cleaning member may collect the liquid by moving relative to the liquid ejecting portion in an extension direction in which the lower end extends.

The nozzle opening surface can be wiped by moving the wiping member in the inclination direction with respect to the inclined nozzle opening surface. Then, the end portion cleaning member moves in the extension direction relative to the liquid ejecting portion. Therefore, even when the liquid cannot be wiped by the wiping member and remains on the nozzle opening surface, the liquid can be collected by wiping the lower end of the nozzle opening surface with the end portion cleaning member smaller than the nozzle opening surface in the extension direction.

C. In the liquid ejecting apparatus, the liquid ejecting portion may have a lower side surface that intersects the nozzle opening surface at the lower end, the second cleaning portion may have a side surface cleaning member configured to wipe the lower side surface by moving relative to the liquid ejecting portion in a state of being in contact with the lower side surface, and the side surface cleaning member may be formed of the absorbing member.

According to this configuration, the second cleaning portion includes the side surface cleaning member that wipes the lower side surface of the liquid ejecting portion. Therefore, for example, even if the liquid scattered during printing adheres to the lower surface, the liquid can be wiped off by the side surface cleaning member. Therefore, the likelihood of liquid that has adhered to the lower side surface coming into contact with the medium can be reduced.

D. In the liquid ejecting apparatus, in the end portion cleaning member, a first distance in a direction of gravity from a first contact portion that contacts the lower end of the nozzle opening surface to a first lower end portion that is a lower end of the end portion cleaning member, and, in the side surface cleaning member, a second distance in the direction of gravity from a second contact portion that contacts the lower side surface to a second lower end portion that is a lower end of the side surface cleaning member may be longer than a height at which the absorbing member sucks up the liquid in the direction of gravity.

The end portion cleaning member and the side surface cleaning member are formed of absorbing members capable of absorbing liquid. In the end portion cleaning member and the side surface cleaning member, the first distance and the second distance, which are the distances from the portion where the first liquid ejecting portion is wiped to the lower end, are longer than the height at which the absorbing member absorbs the liquid. Therefore, the liquid absorbed in the first contact portion and the second contact portion is likely to accumulate on the first lower end portion and the second lower end portion due to gravity, and the liquid absorbed in the first contact portion and the second contact portion can be made less likely to stay in the first contact portion and the second contact portion.

E. In the liquid ejecting apparatus, the second cleaning portion may have a guide member formed of a plate-like member that does not absorb the liquid, and the guide member may be held in state in which a third lower end portion, which is a lower end of the guide member, is located below a first lower end portion of the end portion cleaning member and a second lower end portion of the side surface cleaning member, and the guide member is interposed between the end portion cleaning member and the side surface cleaning member.

According to this configuration, the end portion cleaning member and the side surface cleaning member interpose the guide member. That is, the end portion cleaning member and the side surface cleaning member are in contact with the guide member. Because the third lower end portion of the guide member is located below the end portion cleaning member and the side surface cleaning member, the liquid absorbed by the end portion cleaning member and the side surface cleaning member can be easily released from the end portion cleaning member and the side surface cleaning member.

F. The liquid ejecting apparatus may further include a liquid ejecting portion moving mechanism that moves the liquid ejecting portion to a printing area at which the liquid is ejected onto the medium and a maintenance area adjacent to the printing area, in which the end portion cleaning member may be provided at a position closer to the printing area than the side surface cleaning member in the maintenance area, and the wiping of the lower end by the end portion cleaning member and the wiping of the lower side surface by the side surface cleaning member may be performed by moving the liquid ejecting portion from the maintenance area toward the printing area.

According to this configuration, the end portion cleaning member and the side surface cleaning member wipe the liquid ejecting portion by moving the liquid ejecting portion from the maintenance area toward the printing area. That is, the liquid ejecting portion moves to the printing area in a state in which the liquid adhering to the lower end and lower side surface of the nozzle opening surface is wiped off, so that the risk of soiling the medium located in the printing area can be reduced.

G. In the liquid ejecting apparatus, in the maintenance area, a wiping liquid supply mechanism that can supply a wiping liquid to the lower side surface of the liquid ejecting portion in the inclined state may be provided, and the first cleaning portion may include a wiping member moving mechanism configured to move the wiping member to wipe the nozzle opening surface in the inclined state upward from the lower end.

The wiping liquid supplied to the lower side surface by the wiping liquid supply mechanism is likely to accumulate at the lower end of the nozzle opening intersecting the lower side surface. According to this configuration, the wiping member wipes the nozzle opening surface upward from the lower end. Therefore, the nozzle opening surface can be wiped by using the wiping liquid, and the cleaning effect of the nozzle opening surface can be enhanced. The wiping liquid remaining on the nozzle opening surface and the lower side surface can be wiped by the second cleaning portion.

H. In the liquid ejecting apparatus, the liquid ejecting portion may include a nozzle forming member having an exposed surface where the nozzles open, and a cover member that has a cover bottom surface having a through hole exposing the exposed surface and a cover side surface continuously forming a portion of the lower side surface from the cover bottom surface, the nozzle opening surface may be formed of the exposed surface exposed from the through hole and the cover bottom surface, and a liquid repellency of the cover bottom surface to the liquid may be lower than a liquid repellency of the exposed surface to the liquid.

According to this configuration, regarding the cover bottom surface and the exposed surface forming the nozzle opening surface, the liquid repellency of the cover bottom surface is lower than the liquid repellency of the exposed surface. Therefore, the liquid adhering to the exposed surface easily moves to the cover bottom surface, and the liquid is less likely to remain on the exposed surface. Therefore, even when the nozzle opening surface has irregularities, the nozzle opening surface can be easily wiped.

I. In the liquid ejecting apparatus, a liquid repellency of the cover side surface to the liquid may be lower than the liquid repellency of the cover bottom surface to the liquid.

According to this configuration, the liquid repellency of the cover side surface is lower than the liquid repellency of the cover bottom surface. Therefore, for example, even if the liquid adheres to the cover bottom surface during printing, the liquid easily moves to the cover side surface. Therefore, the likelihood of liquid that has adhered to the cover bottom surface coming into contact with the medium can be reduced.

J. A maintenance method for a liquid ejecting apparatus is a maintenance method for a liquid ejecting apparatus including a liquid ejecting portion that has a nozzle opening surface on which a plurality of nozzles open, and that ejects a liquid from the nozzles to a medium in an inclined state in which the nozzle opening surface is inclined, a wiping member configured to wipe the nozzle opening surface, and an end portion cleaning member formed of a member configured to absorb the liquid and configured to wipe a lower end of the nozzle opening surface in the inclined state, the maintenance method including wiping the nozzle opening surface by moving the wiping member relative to the liquid ejecting portion in a state in which the wiping member is in contact with the nozzle opening surface, and wiping the lower end by moving the end portion cleaning member relative to the liquid ejecting portion in a state in which the end portion cleaning member is in contact with the lower end.

According to this method, the same effects as those of the liquid ejecting apparatus can be obtained.

What is claimed is:

1. A liquid ejecting apparatus comprising:

a liquid ejecting portion that has a nozzle opening surface on which a plurality of nozzles open, and that is configured to eject a liquid from the nozzles to a medium in an inclined state in which the nozzle opening surface is inclined;

a first cleaning portion that has a wiping member configured to move in a first direction to wipe the nozzle opening surface in a state of being in contact with the nozzle opening surface; and a second cleaning portion that is formed of an absorbing member configured to absorb the liquid, the second cleaning portion including an end portion cleaning member configured to wipe a lower end of the nozzle opening surface of the inclined state, wherein the end portion cleaning member collects the liquid by moving, in a second direction that intersects the first direction, in a state of being in contact with the lower end.

2. The liquid ejecting apparatus according to claim 1, wherein the wiping member wipes the nozzle opening surface of the inclined state by moving in an inclination direction.

3. The liquid ejecting apparatus according to claim 1, wherein the liquid ejecting portion has a lower side surface that intersects the nozzle opening surface at the lower end, the second cleaning portion has a side surface cleaning member configured to wipe the lower side surface by moving relative to the liquid ejecting portion in a state of being in contact with the lower side surface, and the side surface cleaning member is formed of the absorbing member.

4. The liquid ejecting apparatus according to claim 3, wherein, in the end portion cleaning member, a first distance in a direction of gravity from a first contact portion that contacts the lower end of the nozzle opening surface to a first lower end portion that is a lower end of the end portion cleaning member, and, in the side surface cleaning member, a second distance in the direction of gravity from a second contact portion that contacts the lower side surface to a second lower end portion that is a lower end of the side surface cleaning member are longer than a height at which the absorbing member sucks up the liquid in the direction of gravity.

5. The liquid ejecting apparatus according to claim 3, wherein the second cleaning portion has a guide member formed of a plate-like member that does not absorb the liquid, and the guide member is held in a state in which a third lower end portion, which is a lower end of the guide member, is located below a first lower end portion of the end portion cleaning member and a second lower end portion of the side surface cleaning member, and the guide member is interposed between the end portion cleaning member and the side surface cleaning member.

6. The liquid ejecting apparatus according to claim 3, further comprising:

a liquid ejecting portion moving mechanism configured to move the liquid ejecting portion to a printing area at which the liquid is ejected onto the medium and a maintenance area adjacent to the printing area, wherein the end portion cleaning member is provided at a position closer to the printing area than the side surface cleaning member in the maintenance area, and the wiping of the lower end by the end portion cleaning member and the wiping of the lower side surface by the side surface cleaning member are performed by moving the liquid ejecting portion from the maintenance area toward the printing area.

7. The liquid ejecting apparatus according to claim 6, wherein, in the maintenance area, a wiping liquid supply mechanism configured to supply a wiping liquid to the lower side surface of the liquid ejecting portion of the inclined state is provided, and the first cleaning portion has a wiping member moving mechanism configured to move the wiping member to wipe the nozzle opening surface of the inclined state upward from the lower end.

8. The liquid ejecting apparatus according to claim 1, wherein the liquid ejecting portion includes a nozzle forming member having an exposed surface where the nozzles open, and a cover member that has a cover bottom surface having a through hole exposing the exposed surface and a cover side surface continuously forming a portion of the lower side surface from the cover bottom surface, the nozzle opening surface is formed of the exposed surface exposed from the through hole and the cover bottom surface, and a liquid repellency of the cover bottom surface to the liquid is lower than a liquid repellency of the exposed surface to the liquid.

9. The liquid ejecting apparatus according to claim 8, wherein a liquid repellency of the cover side surface to the liquid is lower than the liquid repellency of the cover bottom surface to the liquid.

10. The liquid ejecting apparatus according to claim 1, wherein the second direction is an extension direction in which the lower end extends.

11. The liquid ejecting apparatus according to claim 1, wherein the end portion cleaning member configured to wipe the lower end of the nozzle opening surface of the inclined state when the liquid ejecting portion moves in a third direction that intersects the first direction and the second direction.

12. The liquid ejecting apparatus according to claim 1, wherein the liquid ejecting portion configured to move between a printing area where a printing operation is performed and a maintenance area where a cleaning operation is performed.

13. The liquid ejecting apparatus according to claim 12, wherein the wiping member configured to move in the first direction to wipe the nozzle opening surface by moving in the state of being in contact with the nozzle opening surface when the liquid ejecting portion is in the maintenance area, and the end portion cleaning member configured to wipe the lower end of the nozzle opening surface of the inclined state when the liquid ejecting portion moves from the maintenance area to the printing area.

14. A maintenance method for a liquid ejecting apparatus including a liquid ejecting portion that has a nozzle opening surface on which a plurality of nozzles open, and that ejects a liquid from the nozzles to a medium in an inclined state in which the nozzle opening surface is inclined, a wiping member configured to wipe the nozzle opening surface, and an end portion cleaning member formed of a member configured to absorb the liquid and configured to wipe a lower end of the nozzle opening surface of the inclined state in an extension direction in which the lower end extends, the maintenance method comprising:

wiping the nozzle opening surface by moving the wiping member in a first direction relative to the liquid ejecting portion in a state in which the wiping member is in contact with the nozzle opening surface; and wiping the lower end by moving the end portion cleaning member in a second direction that interests the first direction, relative to the liquid ejecting portion in a state in which the end portion cleaning member is in contact with the lower end.

* * * * *